US011612796B2

(12) United States Patent
Dolan

(10) Patent No.: US 11,612,796 B2
(45) Date of Patent: Mar. 28, 2023

(54) MODIFIED BOULE BASED GAME

(71) Applicant: Game Son Ltd., Toronto (CA)

(72) Inventor: Ryan Dolan, Toronto (CA)

(73) Assignee: Game Son Ltd., Toronto (CA)

( * ) Notice: Subject to any disclaimer, the term of this patent is extended or adjusted under 35 U.S.C. 154(b) by 0 days.

(21) Appl. No.: 16/530,271

(22) Filed: Aug. 2, 2019

(65) Prior Publication Data

US 2021/0031085 A1 Feb. 4, 2021

(51) Int. Cl.

| | |
|---|---|
| ***A63B 67/06*** | (2006.01) |
| ***A63B 63/00*** | (2006.01) |
| ***A63B 71/04*** | (2006.01) |
| ***A63B 43/00*** | (2006.01) |

(52) U.S. Cl.

CPC ..... *A63B 67/066* (2013.01); *A63B 43/008* (2013.01); *A63B 63/007* (2013.01); *A63B 71/04* (2013.01); *A63B 2067/061* (2013.01)

(58) Field of Classification Search

CPC ..... A63B 67/066; A63B 43/008; A63B 63/007; A63B 71/04; A63B 2067/061; A63B 67/02

USPC ..... 273/118 R; 473/157–159, 165–167, 473/170–172, 378

See application file for complete search history.

(56) References Cited

U.S. PATENT DOCUMENTS

| | | | | |
|---|---|---|---|---|
| 5,490,671 | A * | 2/1996 | Picard | A63B 71/0672 473/171 |
| 6,383,092 | B1 * | 5/2002 | Ogg | A63B 37/0004 473/378 |
| 8,409,035 | B1 * | 4/2013 | Guyer | A63B 59/60 473/465 |
| 2003/0224878 | A1 * | 12/2003 | Sullivan | A63B 37/0045 473/378 |
| 2005/0012266 | A1 * | 1/2005 | Kelley | A63B 67/066 273/127 R |
| 2006/0270484 | A1 * | 11/2006 | Tamulewicz | A63B 57/357 473/173 |
| 2011/0124427 | A1 * | 5/2011 | Green | A63B 69/3661 473/409 |

* cited by examiner

*Primary Examiner* — Melba Bumgarner
*Assistant Examiner* — Rayshun K Peng
(74) *Attorney, Agent, or Firm* — Mark D. Penner

(57) ABSTRACT

The present invention relates to a new and inventive combination game combining aspects of ball and/or bowling games. The invention further relates to a game set comprising all elements necessary to perform the game and to a method of playing a combined game.

5 Claims, 19 Drawing Sheets

MODIFIED BOULE BASED GAME

FIELD OF INVENTION

The present invention relates to a new and inventive combination game combining aspects of throwing and/or bowling games. The invention further relates to a game set comprising all elements necessary to perform the game and to a method of playing the combined game.

BACKGROUND TO THE INVENTION

Ball, bowling or boule based games involve the throwing, tossing and/or rolling of balls by users or players. All of these sports share in common that players or teams play their boules/balls towards a target. The aim of the game is to throw a ball as near as possible to a target or other marker element. For example, bowl, bocce, and boule employ a plurality of balls where scoring may be based on adjacency to a marker. Players may also try to strike an opponent's ball with their own ball in order to drive the opponent's ball(s) away from its position.

Many of these games, however, cannot be played indoors and those that can be played indoors (such as for example, North American "pin" bowling), require substantial investments in the playing area, equipment (e.g. specialized lanes/tracks, shoes, etc.), and employ complicated rules. Many prior art games require large, permanent courts, or lanes, which require a devoted area for play. As a results, special dedicated sites are required for the paying of these games (e.g. "bowling alleys"). The equipment may also restrict the applicability of players having different skill and fitness levels to enjoy the game concurrently.

The games taught by the prior art do not address the above noted deficiencies. There remains a need for easy to play games that can be used in a variety of locations with limited or no capital expenditures.

SUMMARY OF THE INVENTION

The present invention discloses a modified ball or boule game requiring sufficient skill that can be enjoyed by a wide range of players have a wide range of strength, dexterity and/or skill levels, is safe (e.g. no heavy or sharp objects are thrown), can be used in a variety of locations without the need for specialized facilities (e.g. no specially prepared or expensive surface area is required as in other games like bowling, lawn bowling, or bocce), and can be played in social settings. The simplicity of setup time, court requirements, and a minimum of rules makes the instant game superior to other games where balls are rolled.

An aspect of the present invention is directed to a ball for use in a boule game, the ball comprising an outer surface covered with a plurality of generally truncated pyramidal or pyramidal frustum shaped protuberances in a triangular pattern. A further embodiment of the present invention is directed to the ball disclosed herein wherein the triangular pattern comprises four (4) triangular sections each having protuberances in cross section, and in a further preferred embodiment, triangular section is divided by a border.

Another aspect of the present invention is directed to a boule game playable by a first and second player, the game comprising: (a) a first playing ball for manipulation by the first player to move along a first trajectory and a second playing ball for manipulation by the second player to move along a second trajectory; (b) a plurality of tracks, each track having a generally rectangular but irregularly shape and each track having a first and a second end, the track having a first set of scoring zones disposed along the track; (c) a perch provided at the first end of each track, the perch having a stake and a second set scoring zones; and (d) a lobbing area provided at the second end of each track located a distance away from the first end and from where players can manipulate the ball; wherein the first player manipulates the first playing ball along the first trajectory, the first trajectory generally corresponding to the track and having an end point of the first trajectory desired by the player to be located within the first or second set of scoring zone, and the second player manipulates the second playing ball along the second trajectory, the second trajectory generally corresponding to the track and having an end point of the second trajectory desired by the second player to be located within the first or second scoring zones; wherein a track score is arrived at for each track based on the location of the first playing ball and the second playing ball at the end of play; and wherein the final score for the first and second player is arrived at based on the collectively scores from each track for each player and the player with the highest final score is declared the winner. A further aspect of the invention is directed to the game wherein the perch further comprises a stake and the end points of the first and second trajectory are desired by the players to be located at or near the stake. Yet a further aspect of the invention is directed to the game wherein each track has disposed there within at least one hazards and each player's trajectory is desired to avoid the at least one hazard. Yet a further aspect of the invention is directed to the game wherein the hazards stop the ball from moving or to prevent a ball from advancing. Yet a further aspect of the invention is directed to the game wherein the second scoring zone has a plurality of circular markings inscribing a plurality of pre-allocated points for balls remaining in that area at the end of play for each track. Yet a further aspect of the invention is directed to the game wherein the perch is generally bounded by a barrier other than an open area connecting it to the track. Yet a further aspect of the invention is directed to the game where the first and second player are each comprised of teams of players. Yet a further aspect of the invention is directed to the game wherein the first and second player balls are different colors.

Another aspect of the invention is directed to a method of playing a boule game, the method comprising: (a) a first player located in a lobbing area provided at the first end of a track manipulating a first playing ball to move along a first trajectory of the track, the track having a generally rectangular but irregularly shape and topography and the track a first set of scoring zones disposed along the track and a perch provided at a second end of the track distal from the lobbing area, the perch having a second set of scoring zones; (b) a second player located in the lobbing area manipulating a second playing ball to move along a second trajectory of the track; wherein the first player manipulates the first playing ball along the first trajectory, the first trajectory generally corresponding to the track and having an end point of the first trajectory desired by the player to be located within the first or second set of scoring zone, and the second player manipulates the second playing ball along the second trajectory, the second trajectory generally corresponding to the track and having an end point of the second trajectory desired by the second player to be located within the first or second scoring zones; and wherein a track score is arrived at for the track based on the location of the first playing ball and the second playing ball at the end of play and the player with the highest track score is declared the winner, Yet a further aspect of the invention is directed to the method wherein steps (a) and (b) are repeated for a plurality of tracks and wherein a final score for the first and second player is arrived at based on the collectively scores from each track for each player.

Another aspect of the invention is directed to a boule game kit comprising: (a) a first set of playing ball for manipulation by a first player and a second set of playing ball for manipulation by a second player; (b) a track, each track having a plurality of rings adapted to form a plurality of scoring zones; (c) a stake for placement within one of the scoring zones; and (d) a lobbing area where players can manipulate the ball, the lobbing area to be located a distance away from the track.

BRIEF DESCRIPTION OF THE DRAWINGS

In the drawings, which illustrate embodiments of the invention.

DESCRIPTION OF THE PREFERRED EMBODIMENTS

The description that follows, and the embodiments described therein, is provided by way of illustration of an example, or examples, of particular embodiments of the principles and aspects of the present invention. These examples are provided for the purposes of explanation, and not of limitation, of those principles and of the invention.

It should also be appreciated that the present invention can be implemented in numerous ways, including as a process, method, an apparatus, a system, a device or a method. In this specification, these implementations, or any other form that the invention may take, may be referred to as processes. In general, the order of the steps of the disclosed processes may be altered within the scope of the invention. The description that follows, and the embodiments described therein, is provided by way of illustration of an example, or examples, of particular embodiments of the principles and aspects of the present invention. These examples are provided for the purposes of explanation, and not of limitation, of those principles and of the invention.

It will be understood by a person skilled in the relevant art that in different geographical regions and jurisdictions these terms and definitions used herein may be given different names, but relate to the same respective systems.

In the following specification, it will be understood by a person skilled in the relevant art that the term "player" may refer to individual users or players or a group of people who may play the games of the present invention.

Games of the present invention share some features of existing boule or ball games, but also adds other new and inventive features. The embodiments of the present invention requires skill, and practice in order to improve one's game. A preferred embodiment of the invention is directed to a ball rolling or tossing game that is played on a fairway (or "track") with a playing surface. In a preferred embodiment, the game is played on artificial turf indoors but a person skilled in the relevant art will understand that the game could be played on any surface such as grass, wet sand, artificial material or other non-slick surfaces.

Figure 5A:
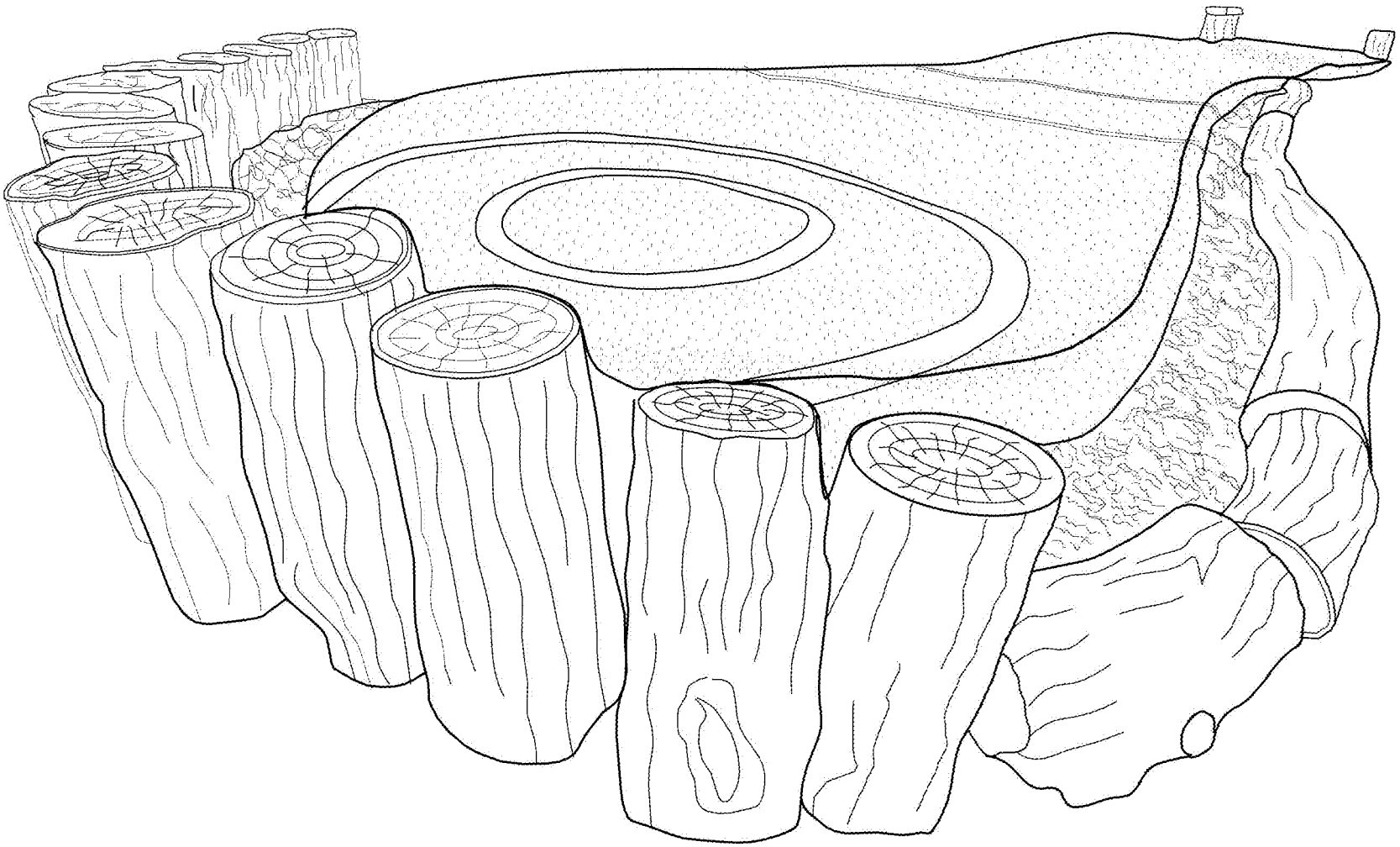
FIGS. 5A and 5B provides a preferred embodiment of the present invention.
Figure 5B:
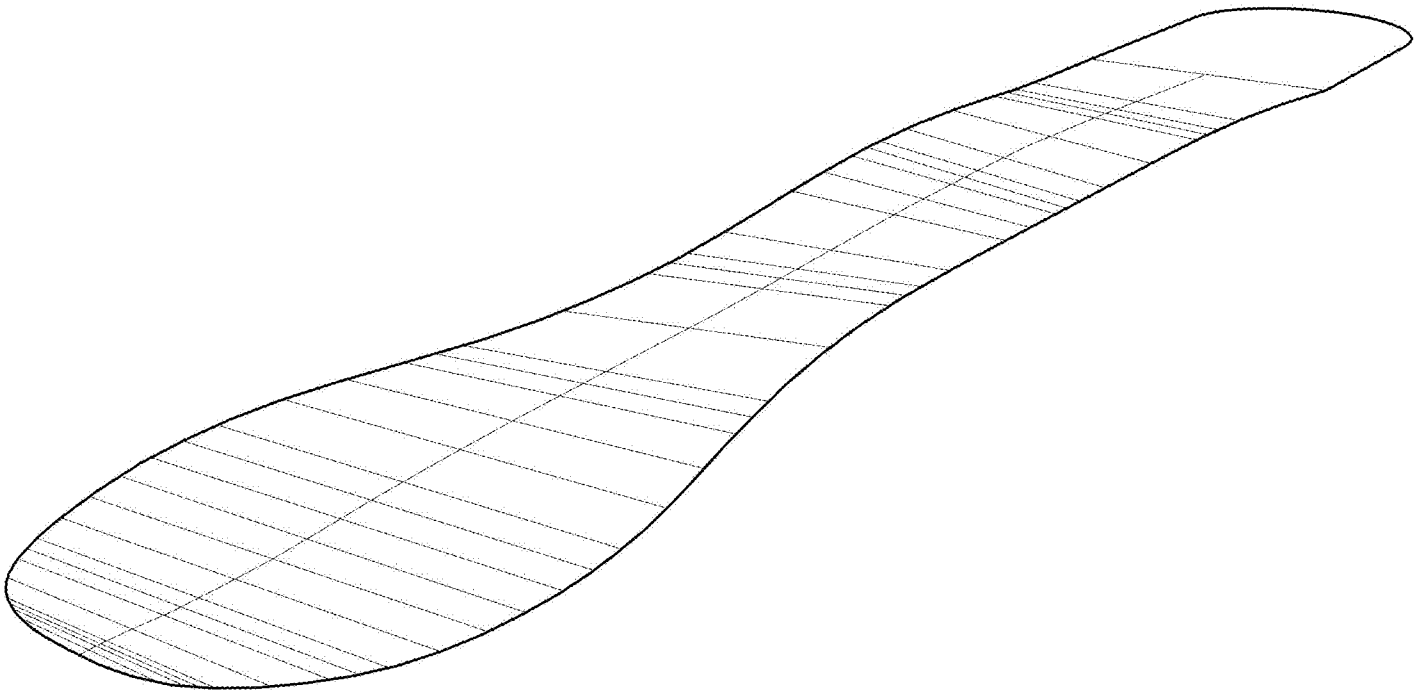
Figure 6A:
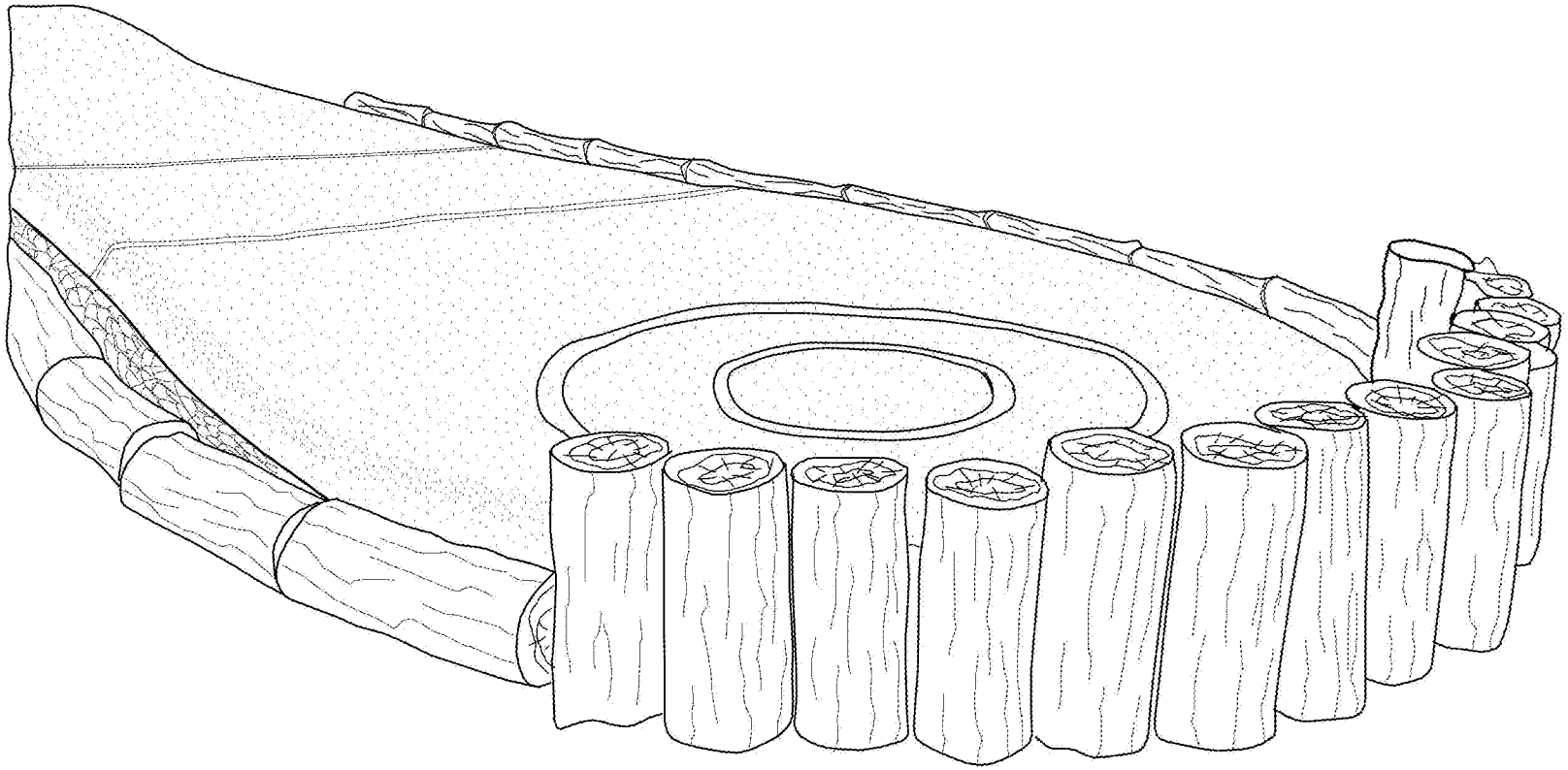
FIGS. 6A and 6B provides a preferred embodiment of the present invention.
Figure 6B:
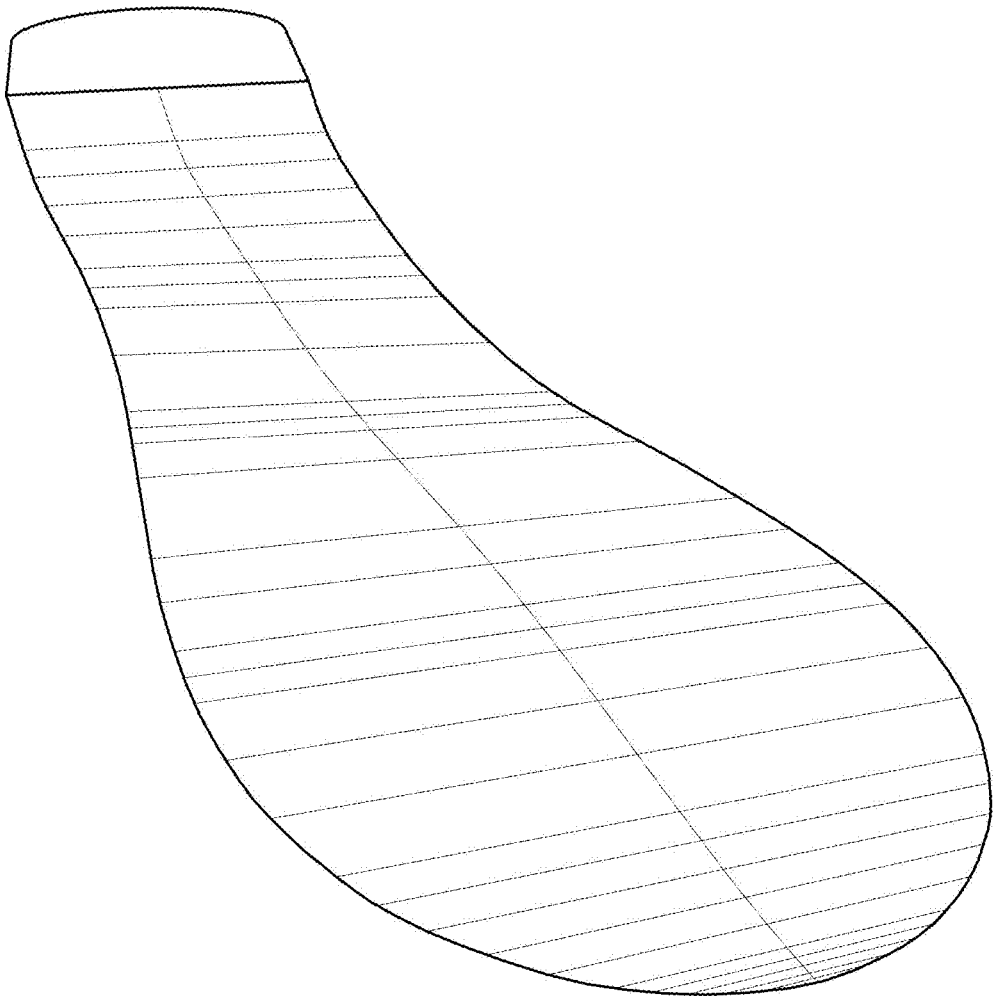
Figure 7A:
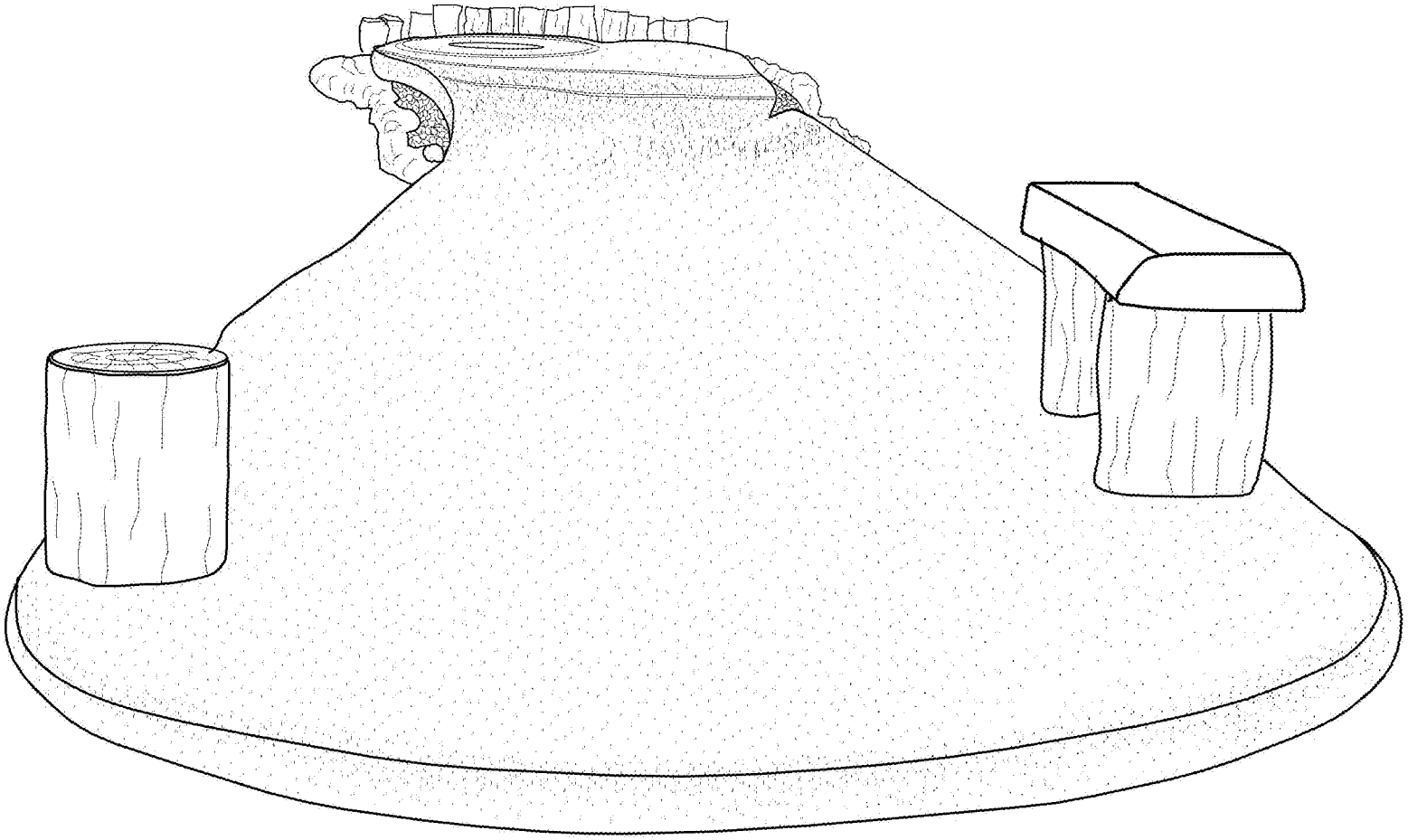
FIGS. 7A and 7B provides a preferred embodiment of the present invention.
Figure 7B:
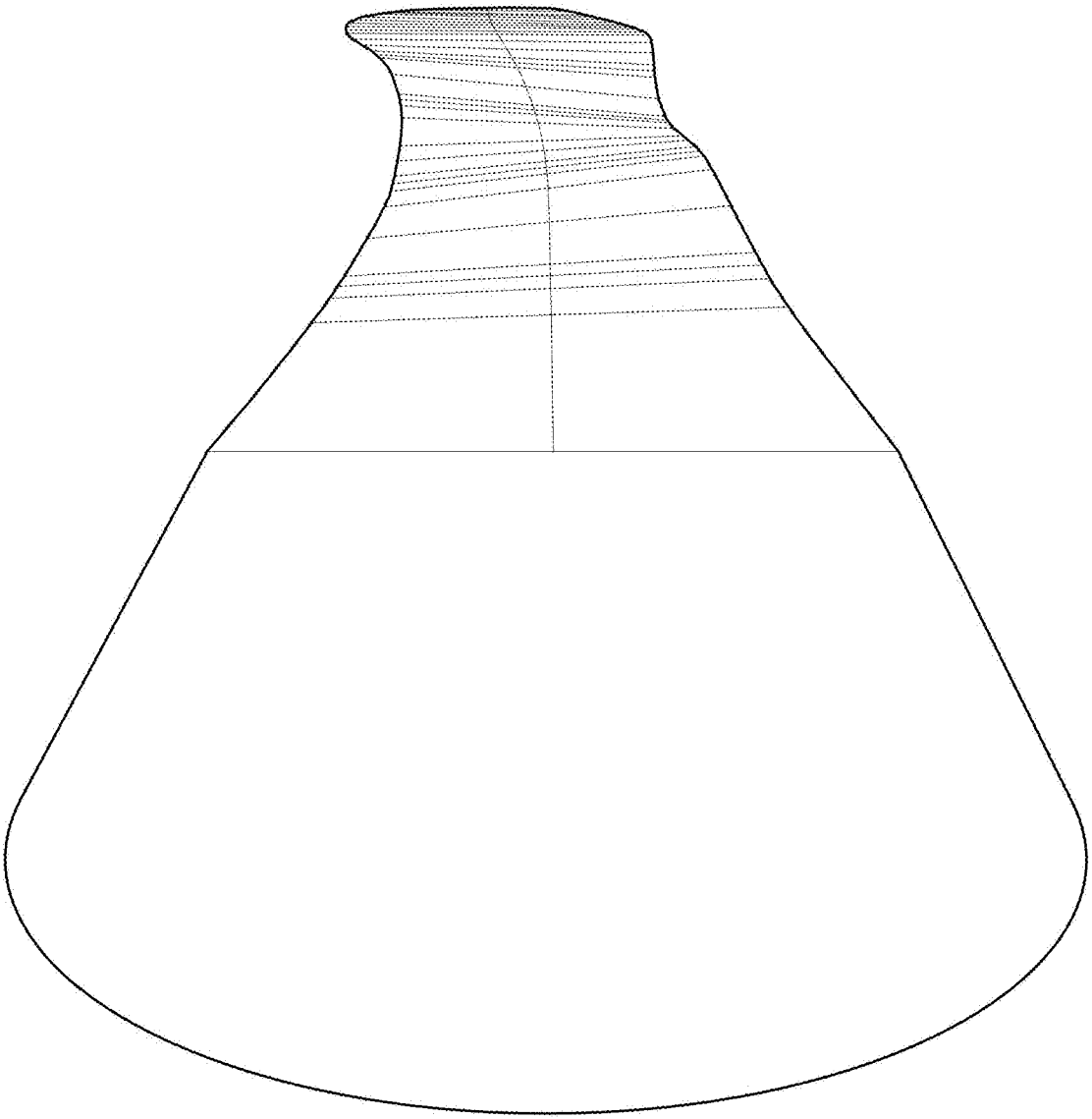
Figure 8:
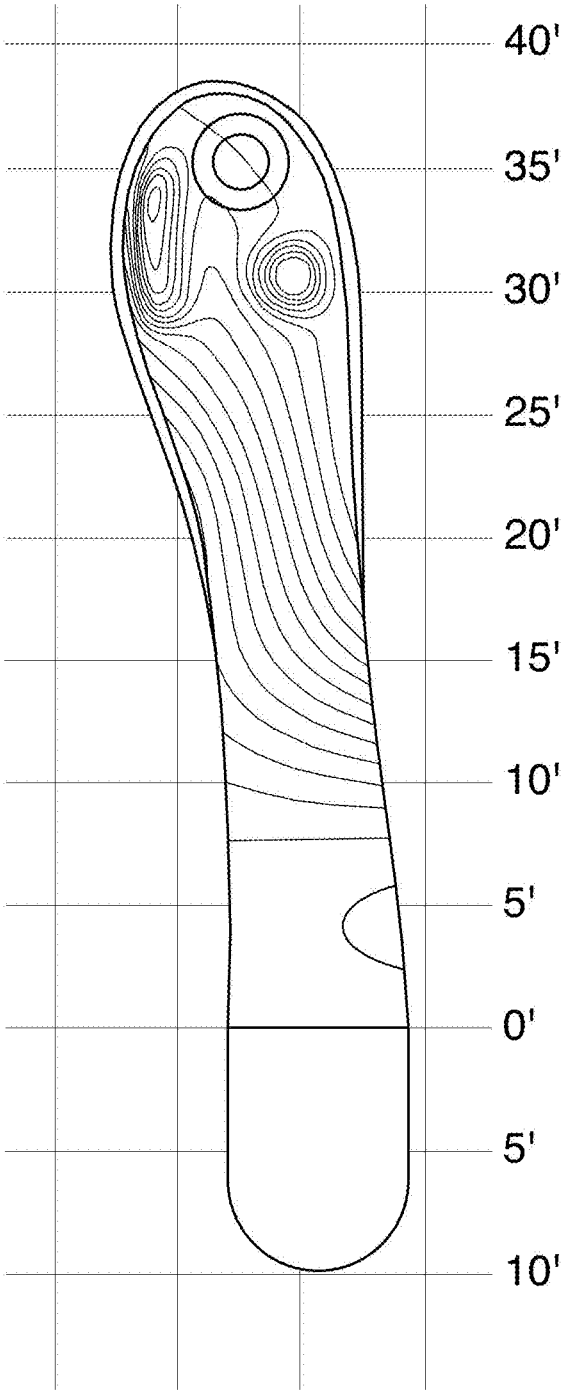
FIG. 8 provides a preferred embodiment of the present invention.
Figure 10:
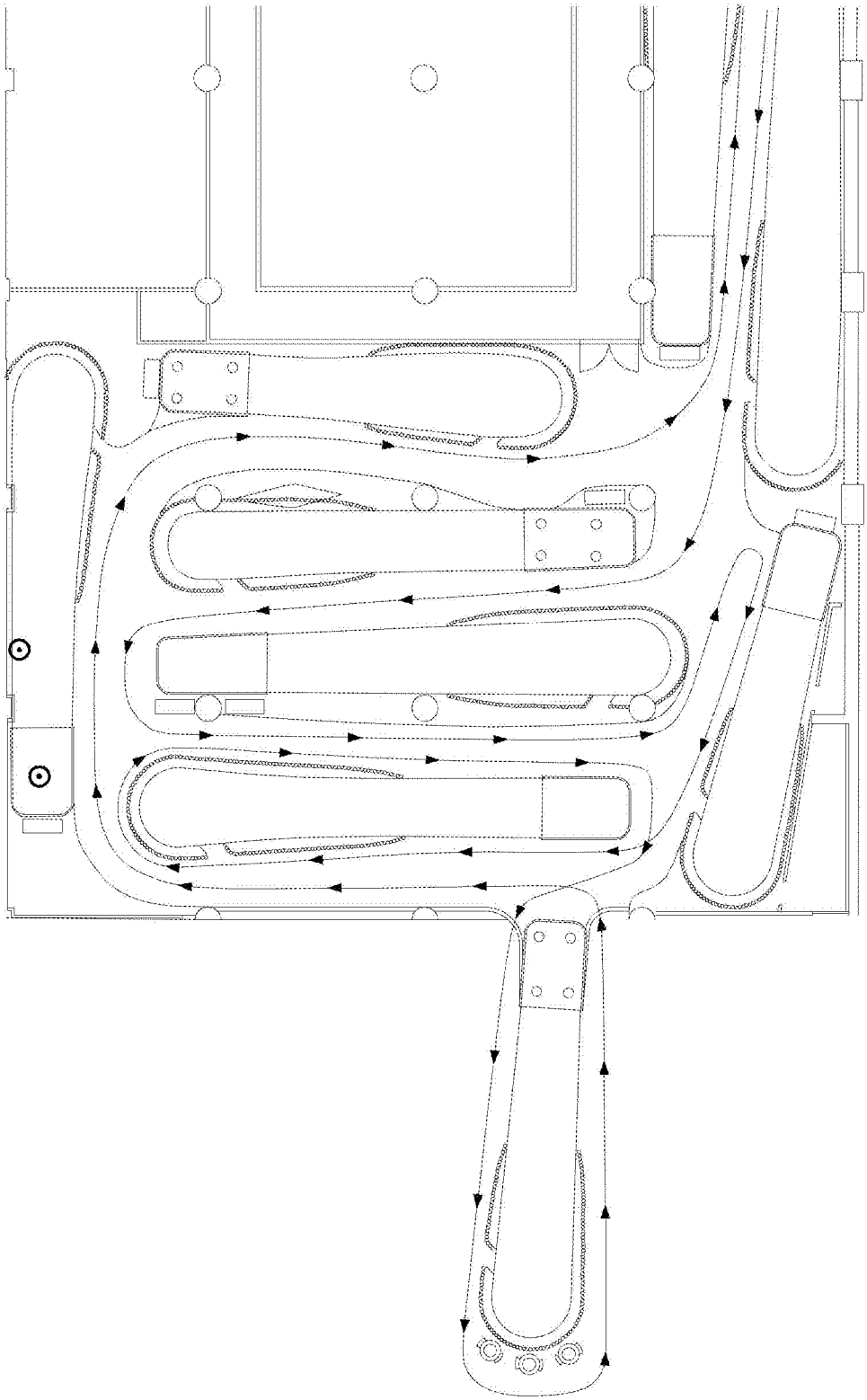
FIG. 10 provides a preferred embodiment of the present invention.

The tracks are designed to maximize game flow for players to minimize waiting time between Tracks (see for example, FIG. 10). An aspect of the present invention is the customizable designed layout as well as the individual topography of the specific tracks that creates interest (see also FIGS. 5(*b*), 6(*b*), and 7(*b*)). A person skilled in the art will understand that a variety of track lengths, (see, for example, FIG. 8), track layouts (see FIG. 10) and track topographies (see FIGS. 5(*a*), 6(*a*), and 7(*a*)) may be employed. This varied design in placement of the tracks and the individual topography of the tracks provides the playing interest. In a preferred embodiment, the topography of each track is considered uneven, thus causing players to alter the trajectory of each manipulated ball to maximize scoring opportunities based on the specific topography of the track. As shown in the FIGS. 5(*b*), 6(*b*), and 7(*b*), each track will have a different topography contributing to the player's interest in the game. Since tracks will generally have uneven topography, considerable expertise may be required to achieve the highest possible score while still maintaining interest for less experienced players.

The game consist of a series of "Tracks" (see 1 in FIG. 1), each consisting of a "teeing", "tee box" or "lobbing" area (see 2 in FIG. 1) from where players 10', 10", 10'" can manipulate (e.g. toss, throw, roll, etc.) the applicable number of balls, each such lobbing area or tee box may have, in a preferred embodiment, a "lob spot" (not shown). There is also provided a "fairway" (see 3 in FIG. 1), a generally rectangular but irregularly shaped area and having an even or uneven topography, between the tee box 2 and a distal scoring end (see 4 in FIG. 1) have a green having a perch 20 and/or stake, one or more "roughs" and other hazards 22 (e.g. uneven terrain, logs, sand, etc., that may, for example, stop the ball from moving or advancing). The green or perch 20, in a preferred embodiment, may have a stake located therein. A player can throw from anywhere within the tee box 2, but both feet must remain in the tee-box.

In a preferred embodiment, there may also be provided a stake which can allow players to easily locate the target area from a distance. In preferred embodiment, the stake may also create a scoring feature referred to as a "leaner", where a player's ball must remain in contact with the stake when the shot is complete.

Figure 2:
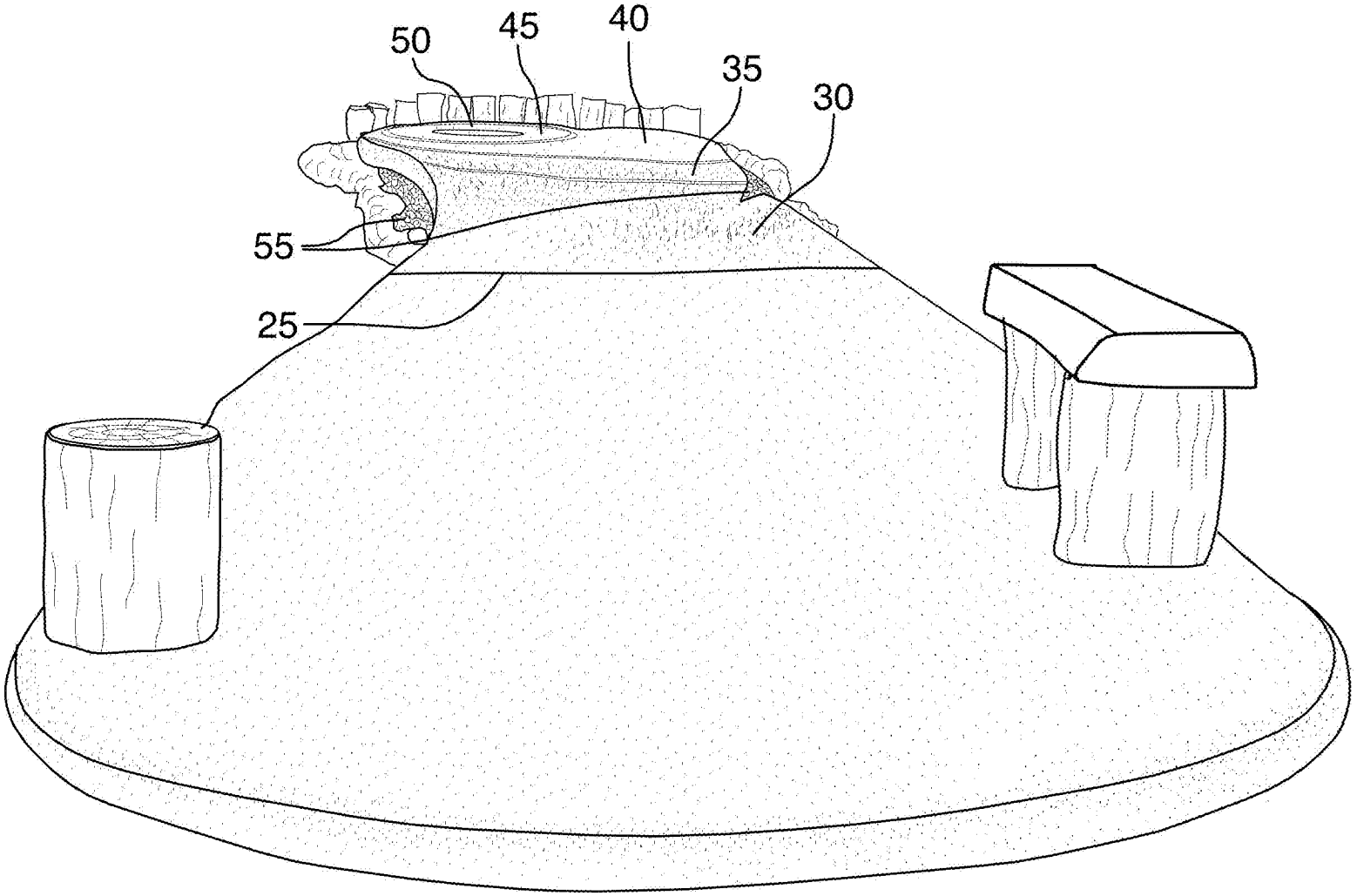
FIG. 2 provides a preferred embodiment of the present invention.
Figure 3:
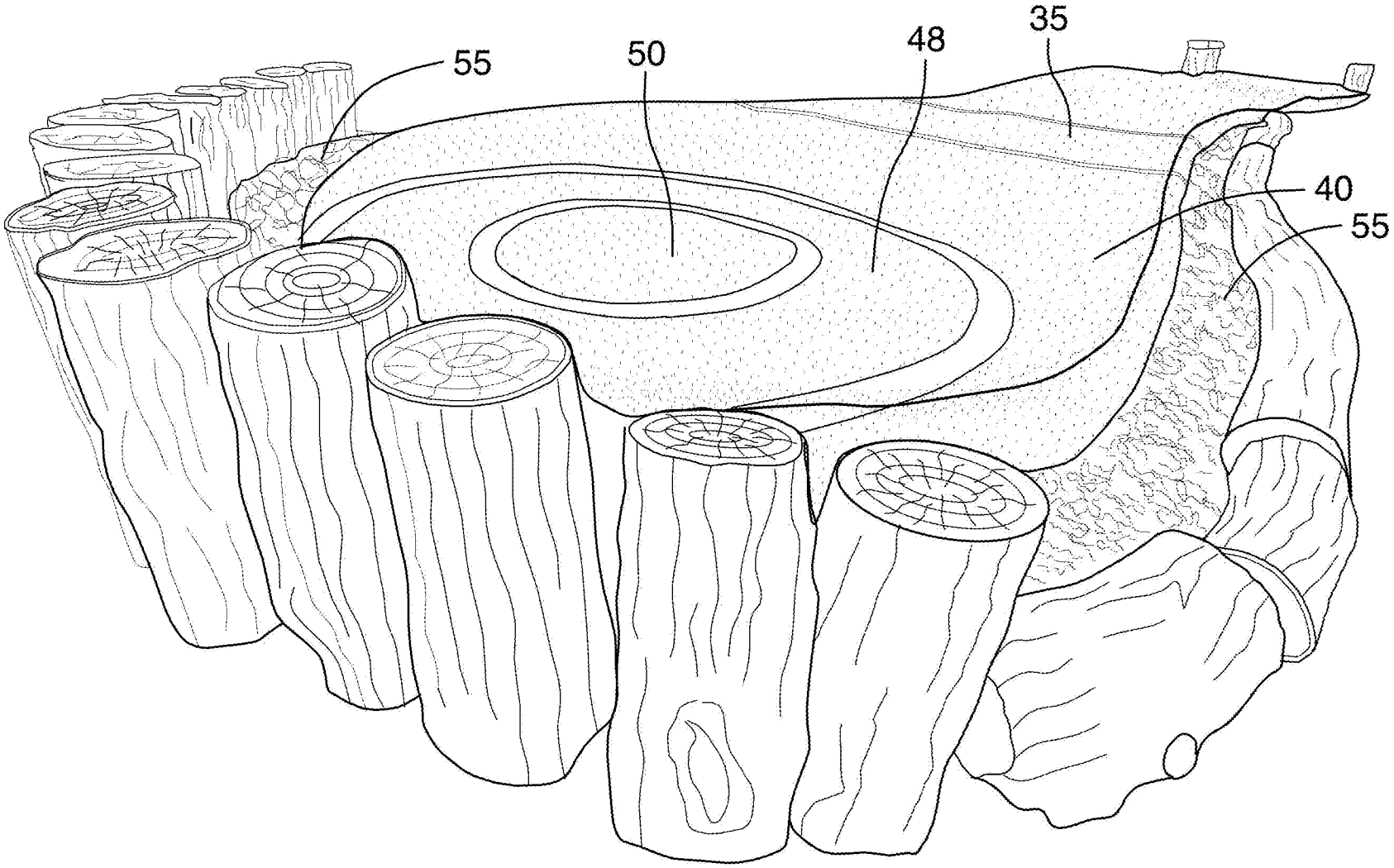
FIG. 3 provides a preferred embodiment of the present invention.
Figure 4:
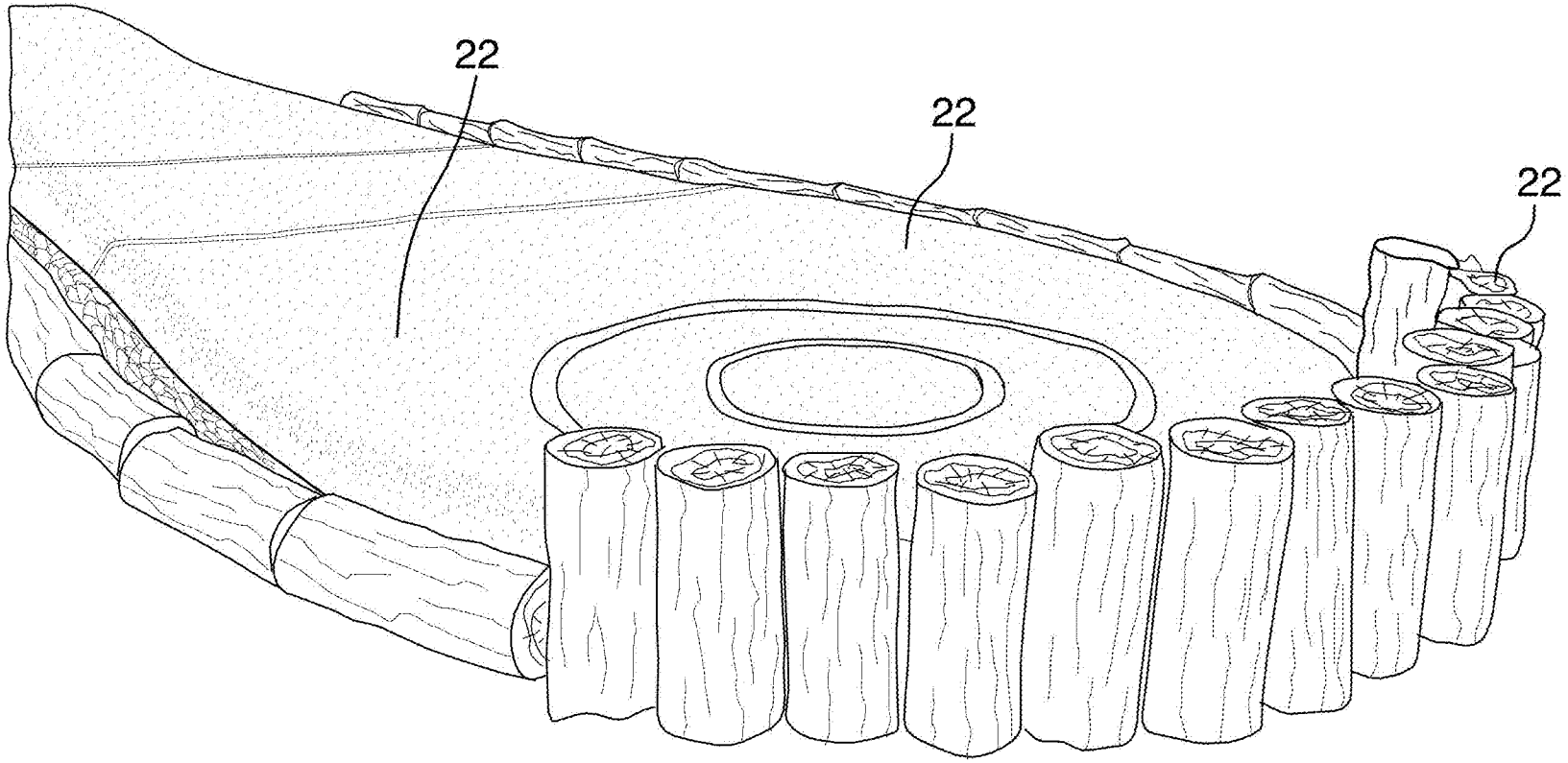
FIG. 4 provides a preferred embodiment of the present invention.

Within the perch and along the track, there are a number of markings inscribing a plurality of areas (see, for example, FIG. 2), the inscribed areas bounded by the markings having pre-determined or pre-allocated points allocated to balls remaining in such areas, such areas referred to as "scoring zones". In a preferred embodiment, the game of the present invention can be played using specialized balls as will be described in greater detail below. A plurality of balls may be used by each player, the balls of one player having contrasting colors from the balls of another player.

Figure 11:
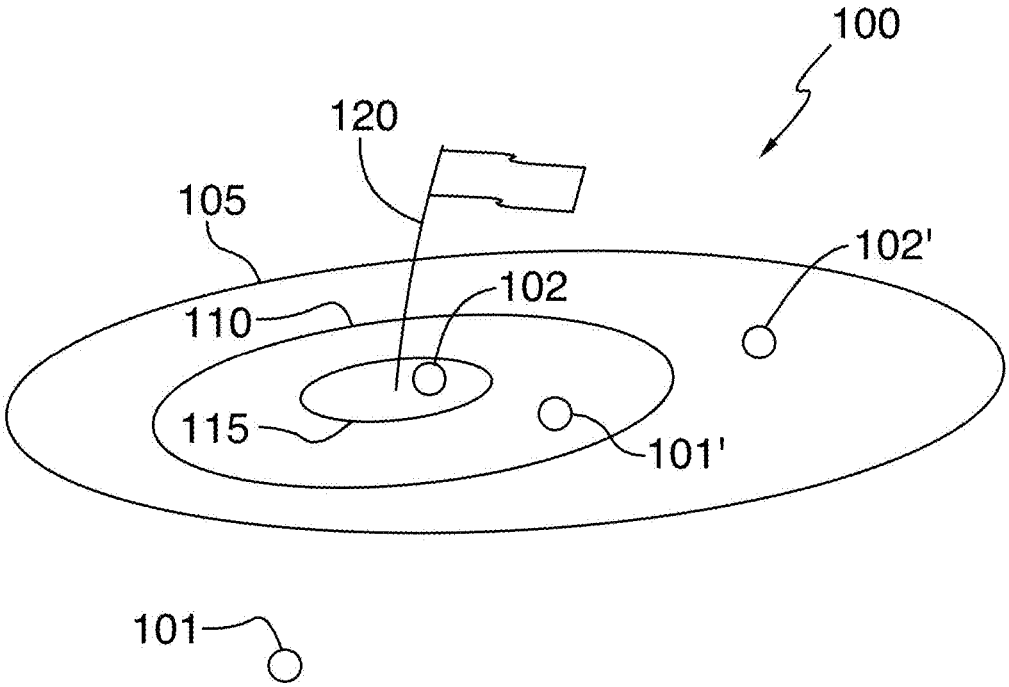
FIG. 11 provides a preferred embodiment of the present invention.

An embodiment of the present invention is directed to a boule or ball game kit that includes a plurality of gaming equipment, pieces, and a track or ring assembly disposed in a carrying bag, case or container. The game kit of the present invention is appointed for providing ready game play on a surface in a recreational area, such as a beach, park or at home. All requisite play equipment and a target assembly are provided within the carrying bag, case or container, including one or more rings/tracks, balls and at least one perch having a stake for each track. The tracks of the game kit are of lightweight construction and can readily be placed on a surface, assembled and secured thereto to yield one or more track having the perch/stake combination. In a preferred embodiment, the game kit would provide a version for use in or around a user's home. In a more preferred embodiment, a version may have one set of rings and two tee boxes to change the direction and hence the topography. In a more preferred embodiment, another version has two sets of rings and four tee boxes to create eight distinct tracks. In FIG. 11, there is provided a representation of a single track 100 that may be provided in the kit. As shown therein, there are provided two sets of balls (101, 102 and 101', 102'), each preferably a distinct colour. There is also provided three rings 105, 110 and 115 which define three scoring zones. In a preferred embodiment, the rings may be assembled and disassembled as appropriate. For example, in the kit, the rings may be provided in one or more disassembled parts or components that can then be assembled when the game is to be played. There is also provide a stake 120 provided in the center of the scoring zone defied by ring 115. As shown in FIG. 11, the balls have lobbed into various positions along the track. Ball 102 is located in the highest point value scoring zone and is also a "leaner" as defined herein. Ball 101' and 102' are disclosed in each of the remaining scoring zones with ball 101 set outside of the scoring zone.

A standard round of the game of the present invention consists of multiple "Tracks" (see for example FIG. 10). In a preferred embodiment, 5 to 10 tracks can be played, in a more preferred embodiment there are 9 tracks. A person skilled in the art will understand that any combination of courses with any combination of tracks could be employed in the current invention. For example, embodiments of the present invention could involve three courses comprised of six tracks. Each track may also be provided with one or more ball retaining areas along the periphery. The ball retaining areas are preferably "troughs" or "gutters", a portion of the troughs having a force absorbing material, such as mulch, synthetic bark, sand, stone, etc.

In a preferred embodiment, the tracks of the present invention will be irregular in shape with their boundaries conforming to a design that maximizes the outlay of tracks within the space provided and, in a preferred embodiment, may be so located as to provide players of greater skill and accuracy an opportunity to achieve better scores than players with lesser skill and accuracy. The tracks are thus designed to provide an optimum variety of play to provide interest for players of different degrees of skill and to enable a player of greater skill to make a better score than a player of lesser skill.

Each player chooses a minimum of two balls of the same color. Mutual consent determines which player begins play. That player can either toss or throw (referred to as "lob") the balls palm down (in the style of Italian bocce) or palm up (in the style of North American bowling). The classic bocce form provides that the ball is held with palm facing the ground, providing more control of both speed and spin. Spin and exact toss direction may be dictated by the player's wrist-action prior to the ball's release. When finesse is not the primary objective of the preferred embodiment, a player may opt for a more rudimentary underhand bowl technique. This style may be preferred when a player has a distinct line that player wants the ball follow along the Track. For example, to knock away an opponent's ball, a player may haves a palm up and knees bent, opposite (lead foot) slightly forward. The player's arm may be extended back, then swung forward and ball is released as it approaches elbow height. In an embodiment of the present invention, a player may toss the ball with either foot planted in a "lob spot". In a preferred embodiment, the lob spot is not provided and instead, a player can throw from anywhere within the tee-box, but both feet must remain in the tee-box.

Figure 1:
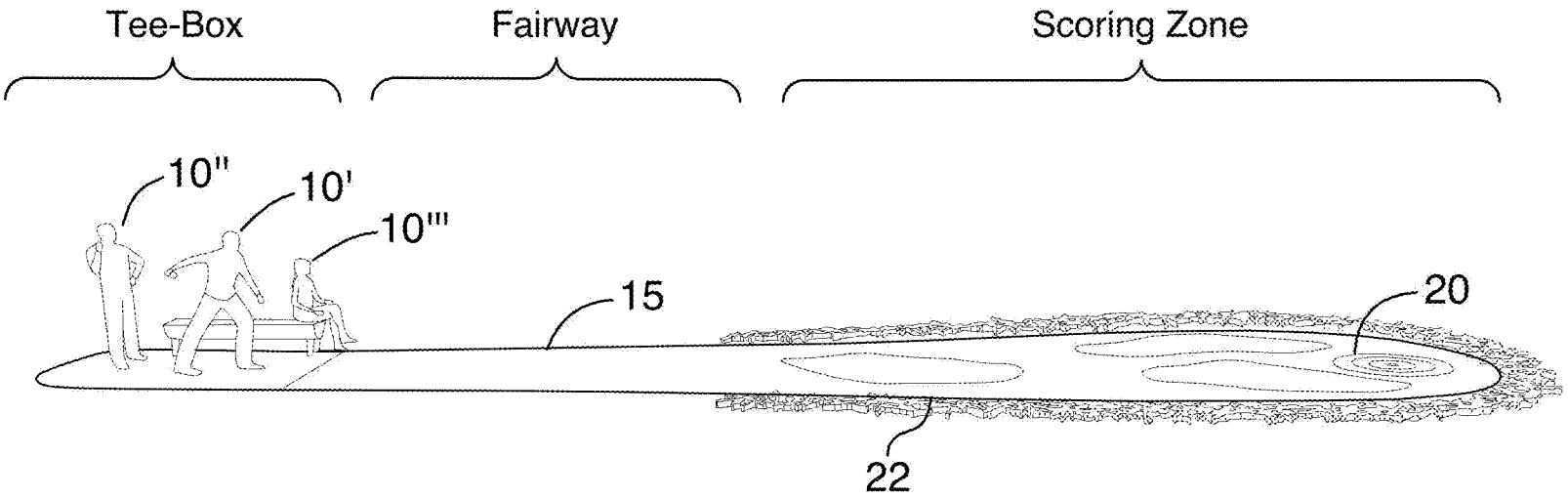
FIG. 1 provides a preferred embodiment of the present invention.

As shown in FIG. 1, a first player 10' manipulates (e.g. rolls or throws, referred to as "lobbing") a ball along a desired trajectory, which corresponds to and is based on the topography of the track 15, in the direction of the perch 20 (and/or the stake, not shown). The desire trajectory is designed to get the ball as close to the perch/stake as possible. Each player (or team of players) alternates lobbing their balls down the track, toward the perch (and/or the stake placed somewhere therein). To be counted or scored, each ball must cross a designated portion of the track referred to as "the line of play" (see 25 in FIG. 2, for example). In a preferred embodiment, the line of play is placed approximately halfway between the tee-box and the perch. A ball not making it to the line of play is scored as a zero. Once a ball has passed the line of play (or first line), it is considered within the first "scoring zone" (30 in FIG. 2) and should it remain in the first scoring zone once play is complete it is "scored" at 1 point (e.g. the player or team who tossed or lobed the ball is awarded 1 point), any ball remaining or provided in the second scoring zone (see 35 in FIG. 2) at the end of play may be scored at 2 points, any ball remaining or provided at the end of play in the third scoring zone (see 40 in FIG. 2) is awarded 3 points. Any ball remaining or provided within the area bounded by the larger ring (see 45 of FIG. 2; the second set of scoring zones) at the end of play may be scored at 4 points. Any ball remaining or provided within the area bounded by the smaller ring (see 50 in FIG. 2) at the end of play may be scored at 5 points. In a preferred embodiment, should a ball be provided or remaining touching the stake (not shown) (referred to as a "leaner") may be awarded 10 points. If the ball does not pass the line of play, the lob may be forfeited. Each player receives at least two lobs per Track, and the score is the sum of those two lobs. Each player may use his lob (e.g. the tossed or rolled ball) to knock the ball(s) of other players out of the ball's initial position. In a preferred embodiment, one of the players may try to move or bump another player's ball into the gutter (see 55 in FIG. 2) or a lessor value scoring zone. Once all balls have been played, the players exit the tee-box. In a preferred embodiment, each players mark their combined scores on the scorecard, collect their balls and proceed to the next Track. Once all Tracks have been played, the scores are collected and the player re teams with the highest score wins the game. If the scores are level after the allotted number of tracks, then an extra sudden-death end may be played.

Two, three, four, six, or eight players may participate in the game based on individual or team play. Individual scoring is used when two or three players participate. Team scoring can be used when 4 or more players participate. Individual scoring or team scoring may be used when four players participate.

In a preferred embodiment, the playing surface of the track should preferably be somewhat resilient and not a slick surface such as a waxed floor or a tile or concrete surface. The track or lane is generally rectangular shape having made of typically a rough surface that may be artificial, such as, for example, in a preferred embodiment, artificial turf for playing surfaces (e.g. short-pile synthetic turf ASTRO-TURF™, or pile systems that use infill materials to better replicate natural turf). However, it will be understood by a person skilled in the relevant art will understand that nature surfaces can be used, such as grass, sand, etc. Hard abrasive surfaces lead to uncontrolled ball speed and create difficulties even in throwing the ball. Moreover, the abrasive surfaces may wear out the equipment. The best surface from the standpoint of standardization is a carpeting material of artificial turf of moderate padding overlying a hard base. The tracks for playing the game may be either outdoors or indoors, and another good playing surface is that of grass, preferably well-mown grass, which provides a well-cushioned underpinning. Every grassy area may be a little bit different, but that is satisfactory so long as the surface is not too bumpy or hilly.

In a preferred embodiment, the tracks of the present invention may be constructed or assembled in a defined space, on a lawn or on any suitable site in a relatively small area. In a preferred embodiment, the tracks may be composed of easily-assembled elements and materials that are weather-resistant and which will withstand continued use and enable users or players to perfect their game and enjoy their game at a lower cost than prior art or conventional adult entertainment facilities. It will be understood by a person skilled in the art that the tracks are design so that the topography thereof remains fix and the track withstand frequent use. More particularly, the invention contemplates the provision of a strong, reinforced frame composed of a tough weather-resistant material (e.g. metal, plastic, fiberglass, and other suitable materials well known in the art), the frame being provided with flooring or other surfacing of the course consisting of a layer of planking, sheet material, concrete or other suitable material having a wear-resistant surface upon which the play surface of the track may be applied. The result of the foregoing construction, is a substantially rectangular frame, which may be made in various sizes, lengths, orientations and elevations according to the plot on which the series of tracks are to be placed. The result of the construction is a playing course which can be readily erected on any suitable site with a minimum of construction effort in comparison to prior art adult entertainment facilities (e.g. bowling lanes, etc.). It can be made in any suitable size and with any reasonable number of tracks, perches, hazards and stakes by adding to or decreasing the length and number thereof. The construction of the course is such that it provides a playing surface and can be easily maintained in a clean and useful condition.

As in boule based games, the ball of the present invention is subject to movement, in this case by the ball striking with the stake provided within the perch or other objects in the game (e.g. the gutter, other balls, logs). This may result either in the ball being moved over the edge of and into another scoring zone or into the gutter or a hazard.

In a preferred embodiment, there is provided a ball comprised of natural or synthetic materials that are well known in the art. The ball may be hollow or solid; in a preferred embodiment, the ball may be hollow. In a more preferred embodiment, these materials may include materials suitable for injection molding or die-casting, including metals (for which the process is called die-casting), glasses, elastomers, confections, and most commonly thermoplastic and thermosetting polymers. In a more preferred embodiment the balls of the present invention may be made through one piece injection molding, and having a bumped design in a triangular array. This ball has superior performance compared to conventional balls that are used in other boule related games, including, raffa, bocce, boule lyonnaise, lawn bowls, pétanque and crown green bowling. On such advantage is that players will have a superior grip to existing prior art devices, thus allowing, among other things, for greater control over the speed, spin, direction, etc. over the ball.

Figure 9:
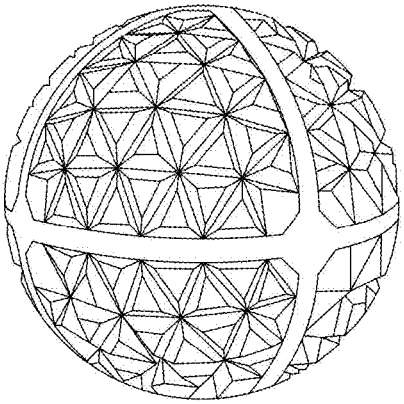
FIG. 9 provides a preferred embodiment of the present invention.

An important feature of the invention resides in the surface pattern of the ball of the invention. Referring to the drawings, and particularly to FIG. 9 thereof, the outer surface of the ball is covered with generally truncated pyramidal or pyramidal frustum shaped bumps or protuberances in a triangular pattern consisting of 4 triangular sections each having protuberances in cross section. Each triangular section is divided by a border. The geometry of the surface pattern of the protuberances will be particularly apparent from inspection of FIG. 9 of the drawings.

The ball has superior performance to comparable previous balls or boules. The ball or boule of the invention is remarkable for its ability to work for everyone. Traditional bocce balls or boules are larger and heavier, which isn't as friendly for kids or people with smaller hands. The surface pattern of the ball/boule allows for players to grip the ball, while also having the boule slide off the turf. Ultimately, this gives the player better control and the ball has the other properties highly desired in a boules sports, including initial velocity, click, durability, rebound, compression, etc.

Figure 12:
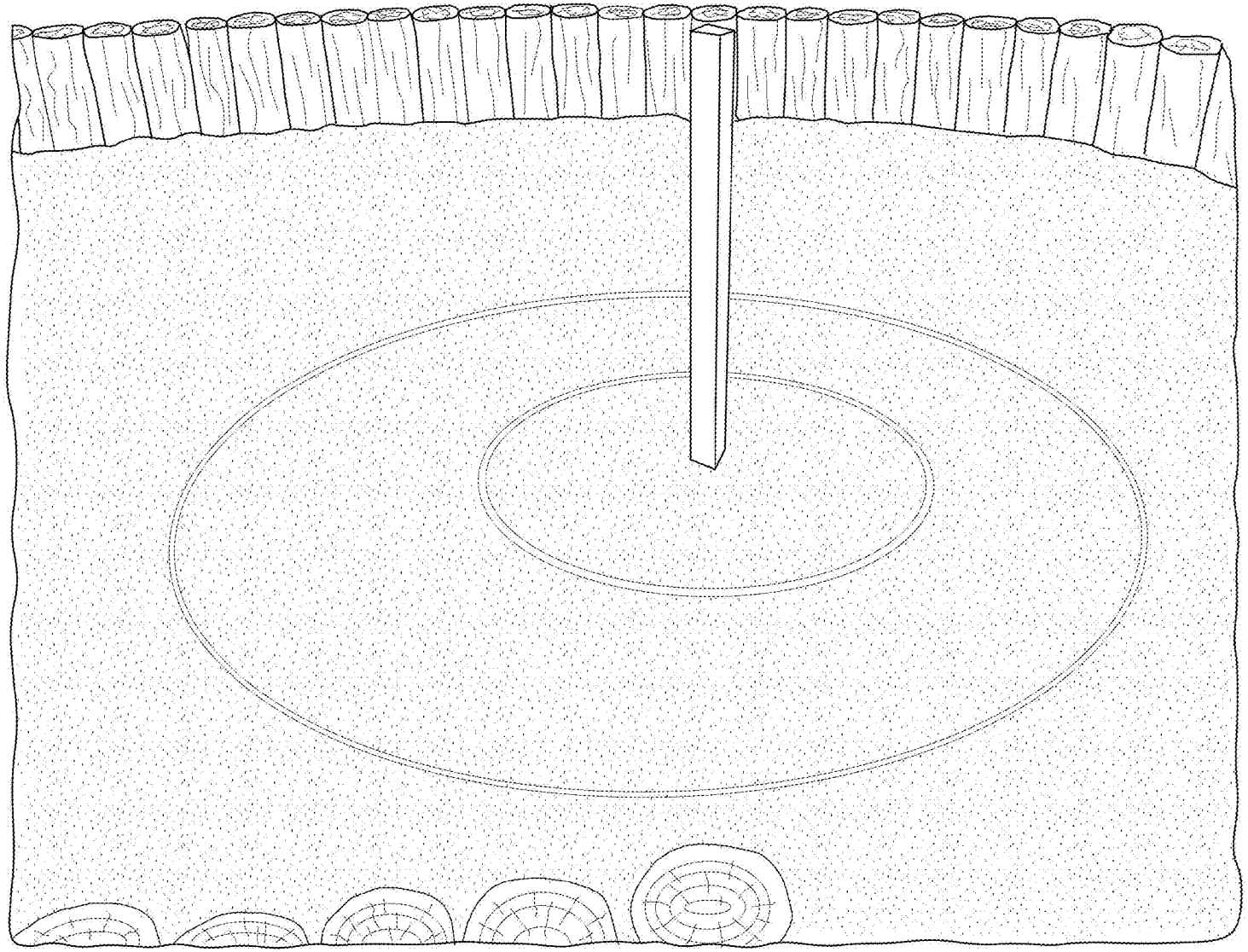
FIGS. 12 to 17 provide preferred embodiments of the present invention.
Figure 13:
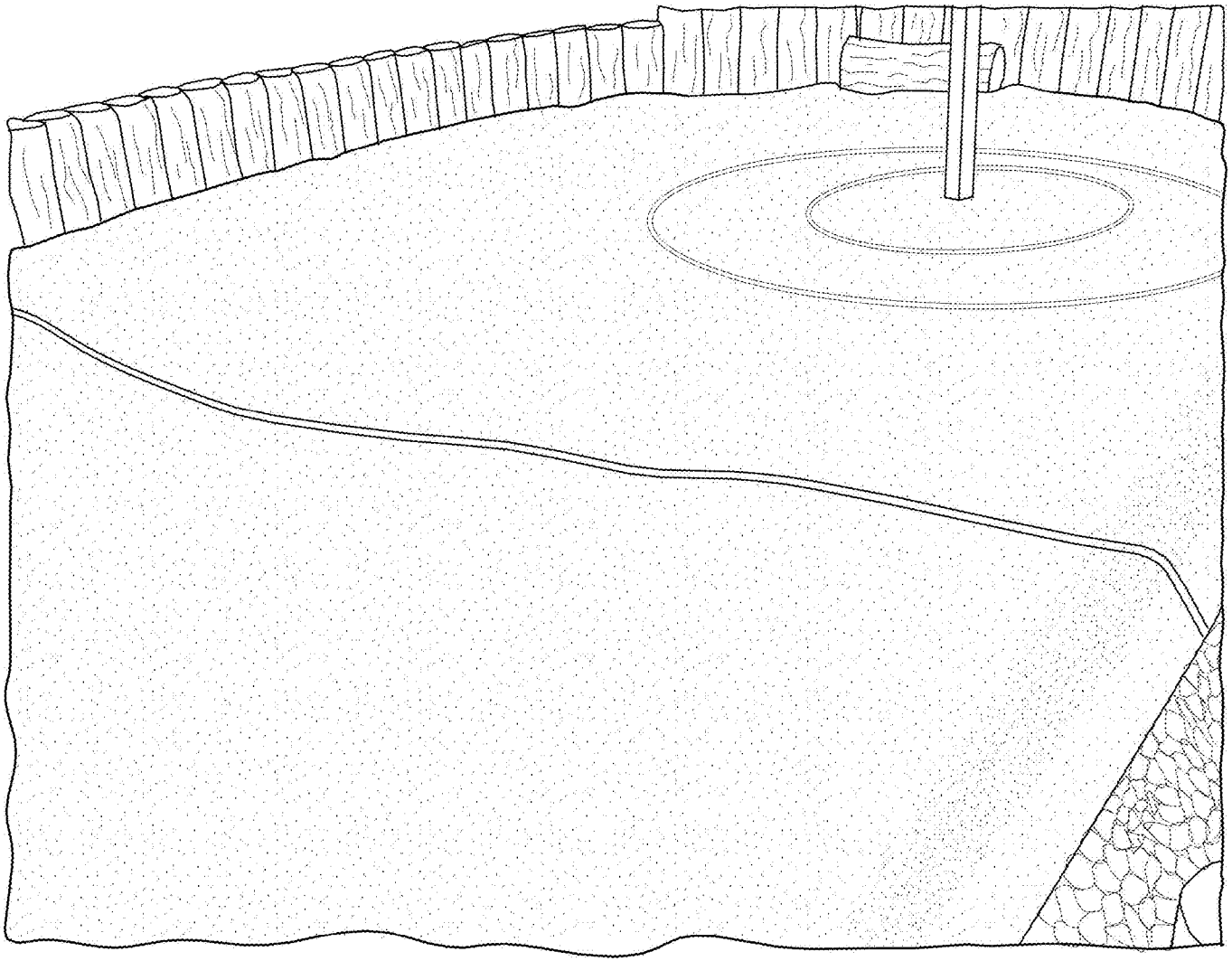
Figure 14:
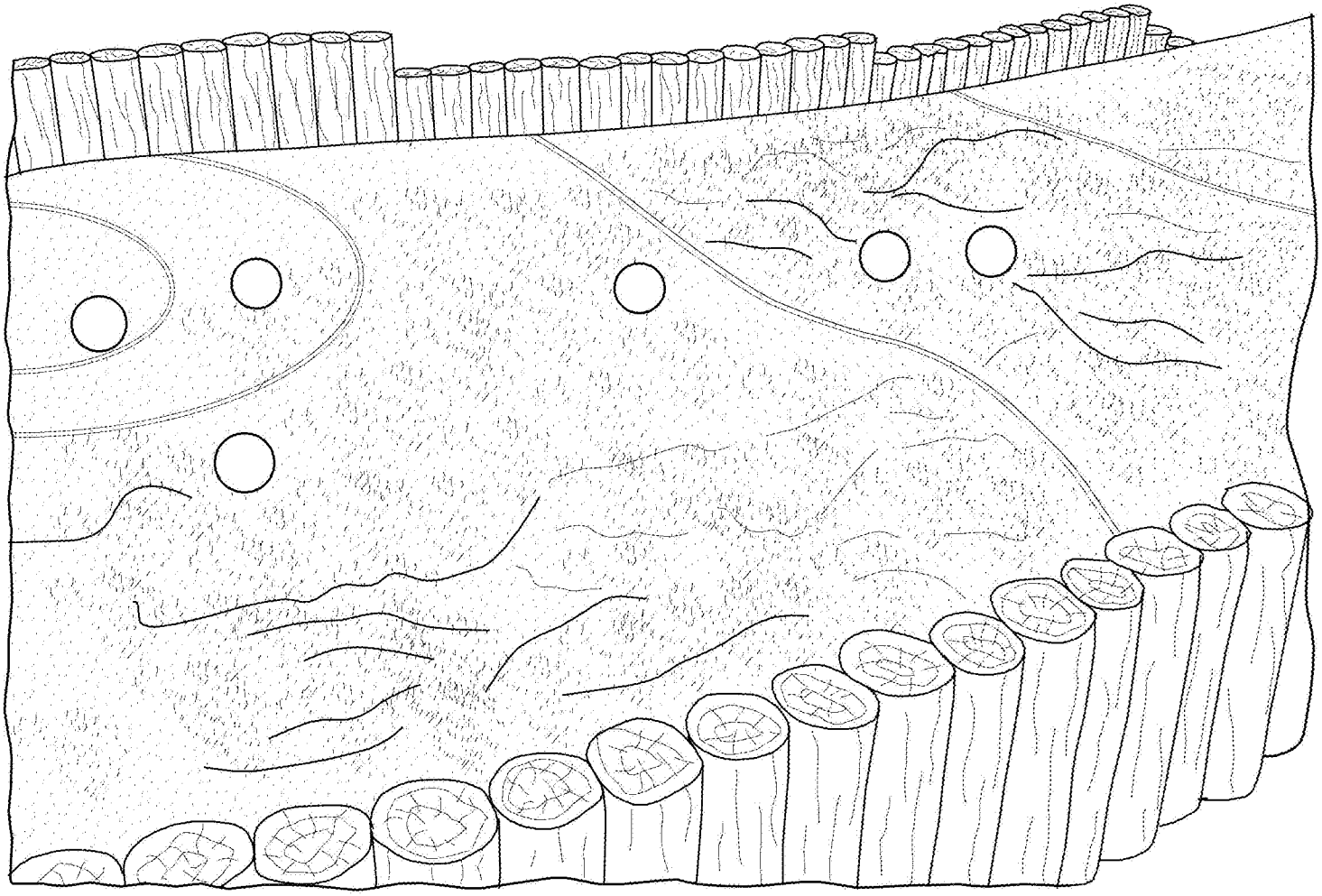
Figure 15:
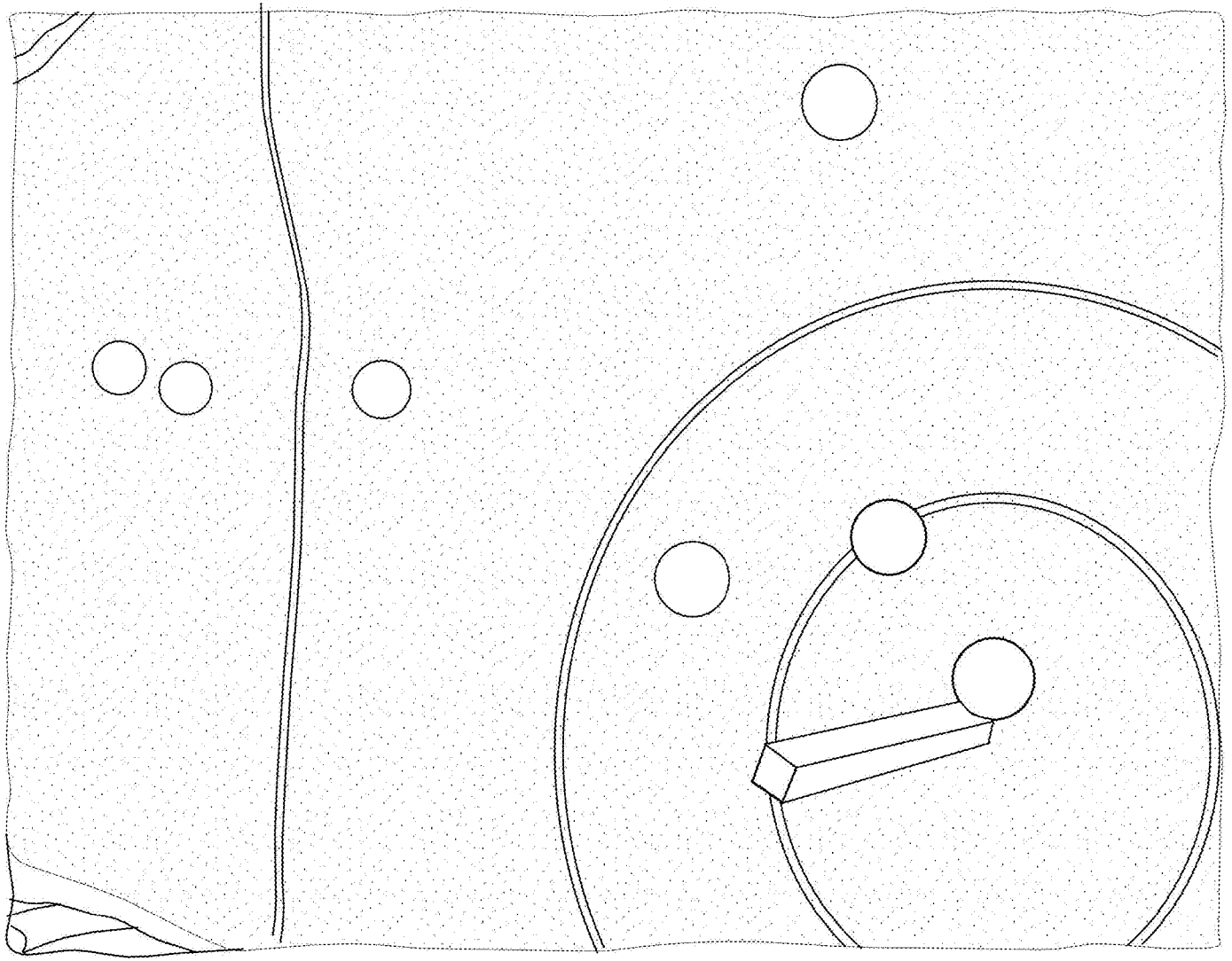
Figure 16:
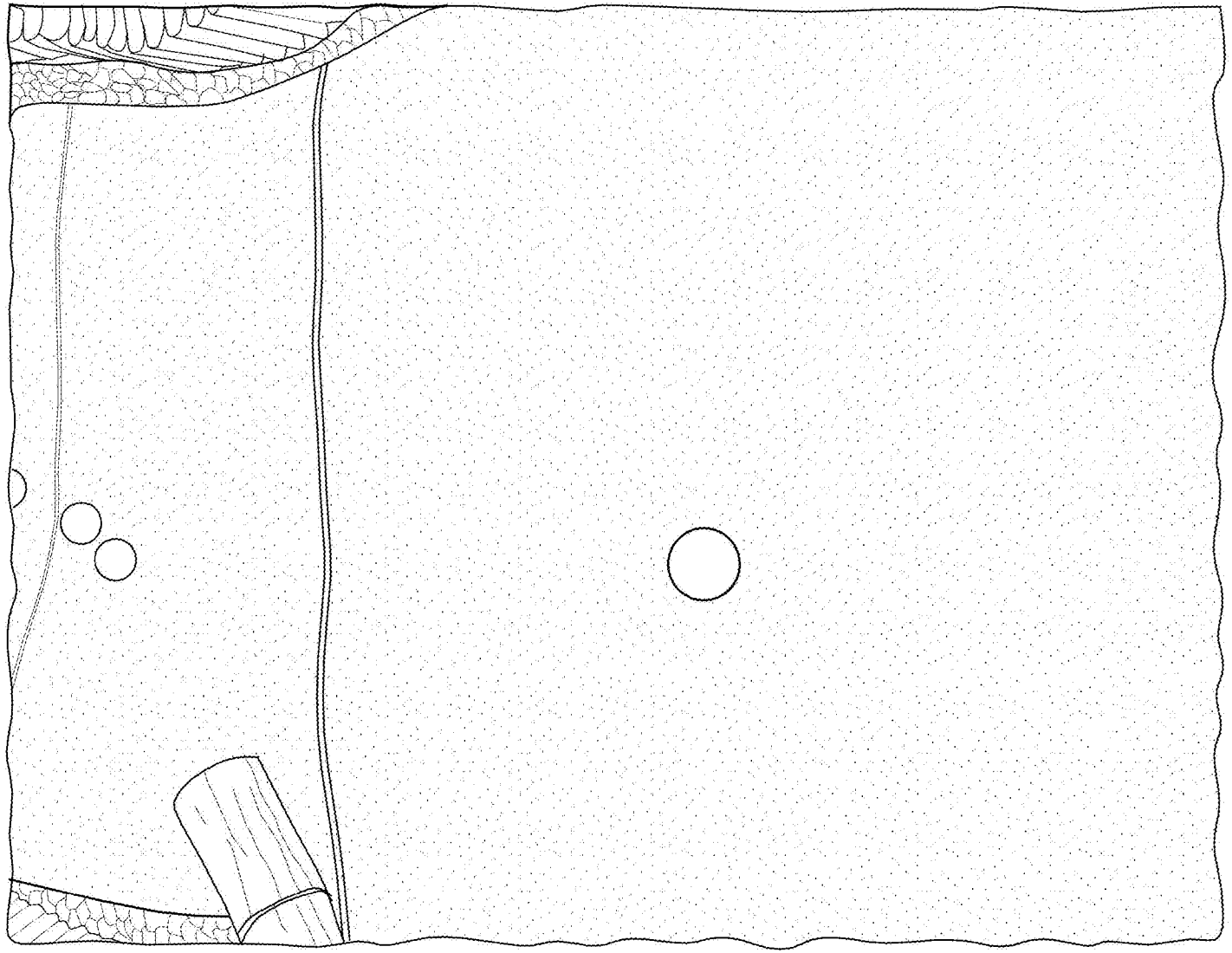
Figure 17:
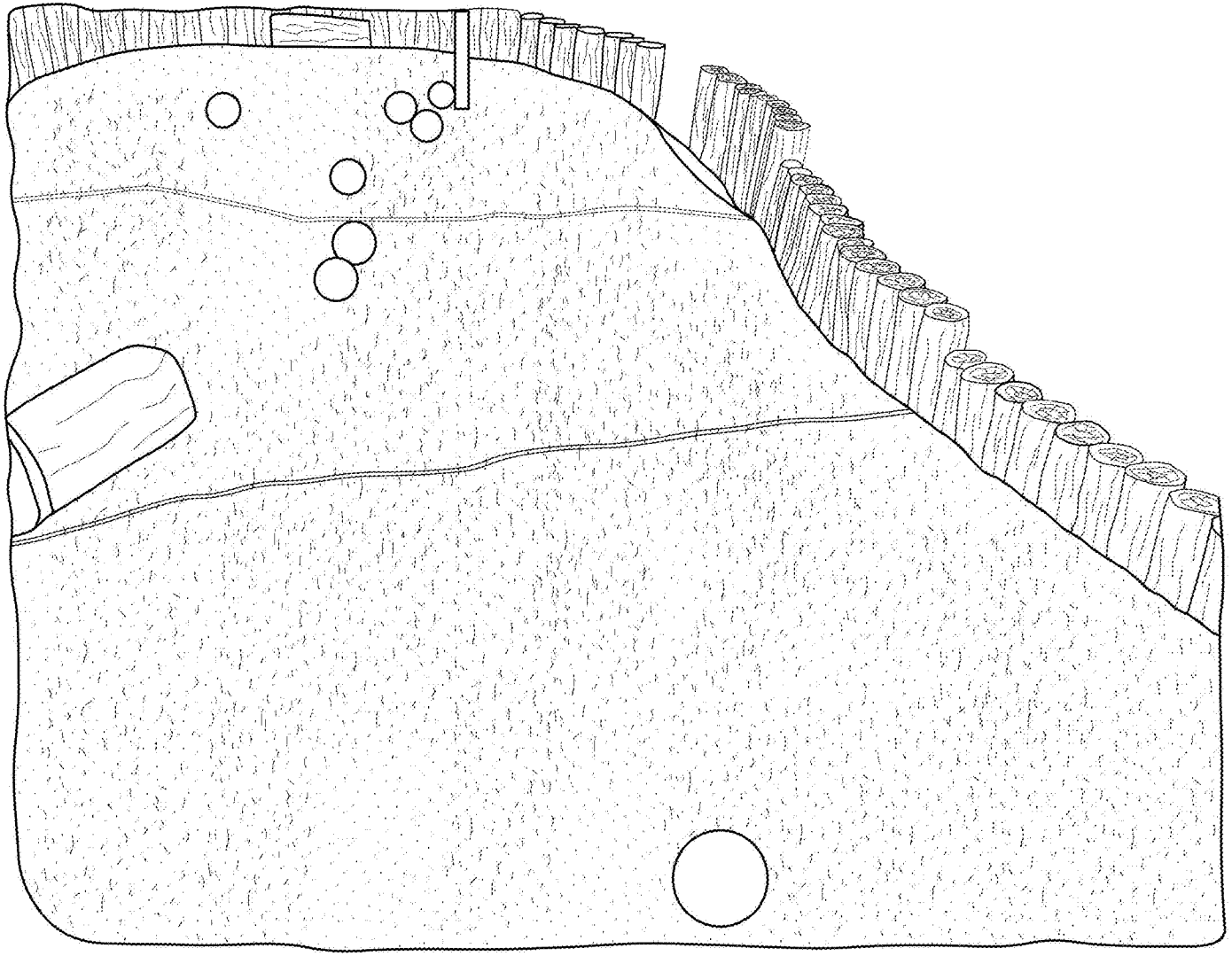

FIGS. 12 to 17 provide various track designs being used in various states of play. FIGS. 12 and 13 shows the perch with the stake and various scoring zones (without any balls played). FIGS. 14 and 15 shows the perch with the stake and various scoring zones (with balls played). FIGS. 16 and 17 show the perch and the track with balls played. In these example, there are four teams or individual players playing the game (e.g. four sets of two balls, each set having a unique color). As can be seen in the FIGS., the balls are dispersed throughout the scoring zones.

The versatility of the surfaces and the ease of setting up a series of tracks provide the instant game the distinct advantage of mobility over the prior art games. The embodiments of the present invention can be played indoors as well as outdoors without substantial investments in the playing area, the equipment, special shoes, and does not employ complicated rules.

All of the specifics mentioned in the description of the game shall not be construed as limitations of the scope of this invention, but rather as an exemplification of one preferred embodiment thereof. Other variations are possible; for example, professionally laid-out and maintained courts, stricter rules of play, and more exacting specifications of equipment.

Although this disclosure has described and illustrated certain preferred embodiments. As shown in FIG. 1, it may be to be understood that the invention may be not restricted to those particular embodiments. Rather, the invention includes all embodiments which are functional or mechanical equivalence of the specific embodiments and features that have been described and illustrated.

I claim:

1. A boule game playable by a first and second player, the game comprising:

(a) a first set of at least two playing balls for tossing unaided by the first player and a second set of at least two playing balls for tossing unaided by the second player, the playing balls each comprising an outer surface covered with a plurality of generally truncated pyramidal or pyramidal frustum shaped protuberances in a triangular pattern;

(b) a plurality of tracks, each track having generally rectangular shape and irregular topography and each track having a first and a second end, each track having a first scoring zone disposed along the track;

(c) a perch provided at the first end of each track, the perch having a stake and a second scoring zone, a third scoring zone, a first circular marking and a second circular marking, the stake located within the second circular marking;

(d) at least one hazard provided along a partial outer perimeter of the perch, wherein each player is desired to avoid tossing unaided the playing balls toward the at least one hazard;

(e) a barrier provided along an outer perimeter of the at least one hazard, wherein the at least one hazard slows or stops the playing balls from moving or prevents the playing balls from advancing, and wherein the barrier preventing the playing balls from leaving the track if the at least one hazard fails to stop the playing ball; and (f) a lobbing area provided at the second end of each track located a distance away from the first end and from where players can toss unaided the playing balls;

wherein the first and second player alternate turns in tossing unaided the playing balls;

wherein the first player tosses unaided playing balls from the first set of at least two playing balls along a first trajectory, the first trajectory generally corresponding to the track and having an end point of the first trajectory desired by the player to be located within the first, second, or third scoring zone, or within the first or second circular marking or near the stake, and the second player tosses unaided playing balls from the second set of at least two playing balls along a second trajectory, the second trajectory generally corresponding to the track and having an end point of the second trajectory desired by the second player to be located within the first, second or third scoring zone, or within the first or second circular marking or near the stake;

wherein if the end point of the first trajectory or the end point of the second trajectory does not pass a line of play, the turn may be forfeited and the playing ball is deemed not to have a score;

wherein a predetermined number of points is associated with the first scoring zone, the second scoring zone, the third scoring zone, the first circular marking or the second circular marking, wherein a track score is arrived at for each track based on the scoring zone or circular marking that the first set of playing balls and the second set of playing balls is within at the end of play;

wherein if the first set of playing balls and the second set of playing balls is in contact with the stake at the end of play, the player who tossed unaided said playing balls is awarded towards the player's track score the highest number of points available for the track; and wherein the final score for the first and second player is arrived at based on the collectively scores from each track for each player and the player with the highest final score is declared the winner.

2. The game of claim 1 where the first and second player are each comprised of teams of players.

3. The game of claim 2 wherein the first and second player balls are different colors.

4. A method of playing a boule game, the method comprising:

(a) a first player located in a lobbing area provided at the first end of a track tossing unaided a first set of at least two playing balls to move along a first trajectory of the track, the track having a generally rectangular shape and irregular topography, the track having a first scoring zone disposed along the track and a line of play, and a perch provided at a second end of the track distal from the lobbing area, the perch having a second scoring zone, a third scoring zone, a first circular marking, and a second circular marking and a stake, the perch partially surrounded by at least one hazard, the at least one hazard partially surrounded by a barrier, wherein each player is desired to avoid tossing unaided the playing balls toward the at least one hazard, wherein the at least one hazard slows or stops the playing balls from moving or prevents the playing balls from advancing, and wherein the barrier prevents the playing balls from leaving the track if the at least one hazard fails to stop the playing balls;

(b) a second player located in the lobbing area tossing unaided a second set of at least two playing balls to move along a second trajectory of the track;

wherein the playing balls each having an outer surface covered with a plurality of generally truncated pyramidal or pyramidal frustum shaped protuberances in a triangular pattern, and wherein the first and second player alternate turns in tossing unaided the playing balls, the first player tosses unaided the first set of at least two playing balls along the first trajectory, the first trajectory generally corresponding to the track and having an end point of the first trajectory desired by the player to be located within the first second, or third scoring zone, or within the first circular marking or the second circular marking, or near the stake, and the second player tosses unaided the second set of at least two playing balls along the second trajectory, the second trajectory generally corresponding to the track and having an end point of the second trajectory desired by the second player to be located within the first second, or third scoring zones, or within the first circular marking or the second circular marking, or near the stake;

wherein if the end point of the first trajectory or the endpoint of the second trajectory does not pass the line of play, the turn may be forfeited and the playing ball is deemed not to have a score;

wherein a predetermined number of points is associated with the first scoring zone, the second scoring zone, the third scoring zone, the first circular marking or the second circular marking;

wherein a track score is arrived at for the track based on the scoring zone or circular marking that the first set of playing balls and the second set of playing balls is within at the end of play, wherein if the first set of playing balls and the second set of playing balls is in contact with the stake at the end of play, the playing who tossed unaided said playing balls is awarded towards the player's track score the highest number of points available for the track; and wherein the player with the highest track score is declared the winner.

5. The method of claim 4 wherein steps (a) and (b) are repeated for a plurality of tracks and wherein a final score for the first and second player is arrived at based on the collectively scores from each track for each player.

* * * * *